US005659978A

United States Patent [19]

Bell et al.

[11] Patent Number: 5,659,978

[45] **Date of Patent: *Aug. 26, 1997**

[54] FOOTWEAR HAVING A SOLE WITH A TOE STRAPPING ASSEMBLY

[75] Inventors: Michael Bell, 1705 Triumphe Way, Warrington, Pa. 18976; Jonathan Bell, Philadelphia, Pa.

[73] Assignee: Michael Bell, Warrington, Pa.

[ * ] Notice: The term of this patent shall not extend beyond the expiration date of Pat. No. 5,533,277.

[21] Appl. No.: 629,679

[22] Filed: Apr. 9, 1996

Related U.S. Application Data

[63] Continuation-in-part of Ser. No. 296,829, Aug. 26, 1994, Pat. No. 5,533,277.

[51] Int. Cl.[6] ..... A43C 15/06

[52] U.S. Cl. ..... 36/7.6; 36/62; 36/11.5

[58] Field of Search ..... 36/7.6, 59 C, 65, 36/7.5, 59 A, 67 R, 59 R, 103, 7.1 R, 7.1 A, 7.7, 11.5, 62, 66, 67 A–67 D

[56] References Cited

U.S. PATENT DOCUMENTS

| | | | |
|---|---|---|---|
| D. 131,318 | 2/1942 | Levin . | |
| 1,032,600 | 7/1912 | Grout . | |
| 1,484,178 | 2/1924 | Lagasse et al. | 36/7.7 |
| 1,487,390 | 3/1924 | King | 36/7.6 |
| 2,361,972 | 11/1944 | Smith . | |
| 2,580,840 | 1/1952 | Rogndal | 36/29 |
| 2,714,768 | 8/1955 | Badler | 36/7.6 X |
| 2,801,478 | 8/1957 | Gilbert . | |
| 3,029,529 | 4/1962 | Schwartz | 36/134 X |
| 3,214,850 | 11/1965 | McNair . | |
| 3,359,659 | 12/1967 | Smolnik | 36/7.6 |
| 3,516,181 | 6/1970 | Jordan . | |
| 4,329,790 | 5/1982 | Bell | 36/59 C X |
| 4,344,238 | 8/1982 | Peyser . | |
| 4,353,172 | 10/1982 | Bryant . | |
| 4,378,643 | 4/1983 | Johnson | 36/129 |
| 4,525,939 | 7/1985 | McNeil et al. . | |
| 4,538,366 | 9/1985 | Norton | 36/59 C X |
| 4,694,591 | 9/1987 | Banich et al. | 36/102 |
| 4,742,626 | 5/1988 | Tadiotto | 36/127 |
| 4,817,302 | 4/1989 | Saltsman . | |
| 4,869,000 | 9/1989 | York, Jr. . | |
| 4,910,883 | 3/1990 | Zock, Jr. . | |
| 4,914,838 | 4/1990 | Ihlenburg | 36/128 |
| 4,920,664 | 5/1990 | McGregor et al. . | |
| 5,351,421 | 10/1994 | Miers | 36/128 |
| 5,533,277 | 7/1996 | Bell et al. | 36/7.6 |

FOREIGN PATENT DOCUMENTS

| | | | |
|---|---|---|---|
| 242559 | 9/1965 | Austria | 36/59 C |
| 2030436 | 5/1992 | Canada | 36/7.6 |
| 582749 | 12/1924 | France | 36/62 |
| 830912 | 1/1952 | France . | |
| 3127793 | 1/1983 | Germany | 36/134 |
| 92/14373 | 9/1992 | WIPO | 36/59 C |

*Primary Examiner*—Ted Kavanaugh
*Attorney, Agent, or Firm*—Caesar, Rivise, Bernstein, Cohen & Pokotilow, Ltd.

[57] ABSTRACT

An ice-gripping sandal for releasable mounting on the foot of a person or on the sole of a boot or other primary footwear worn by the person. The sandal comprises a sole, a toe strapping assembly and a heel strapping assembly for mounting the sandal on the boot. The sandal's sole has a bottom surface having plural groups of cleats projecting therefrom. Some of the cleats are located within a forefoot and toe portion of the sole and extend at an acute angle to the longitudinal axis of the sole. These cleats include end portions having respective ice-gripping screws mounted therein. Grooves are provided between the cleats in the forefoot and toe portions of the sole, with the width and depth of the grooves increasing from the medial side of the sole to the lateral side of the sole. The grooves enable material which may tend to adhere to the sole within the grooves to be forced out of the grooves when the wearer walks. In order to increase the flexibility of the sole plural recesses are provided in the arch region contiguous with the forefoot portion.

9 Claims, 4 Drawing Sheets

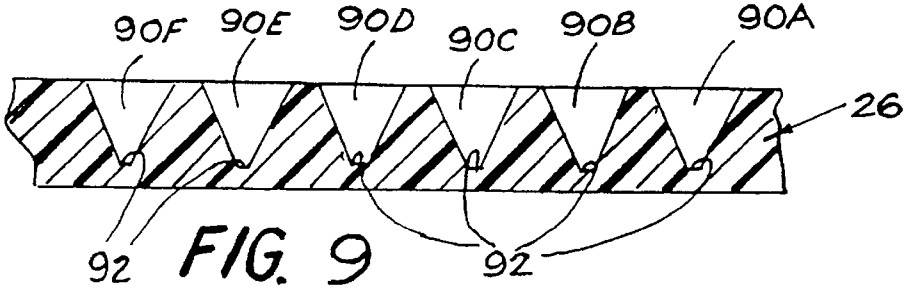
FIG. 9
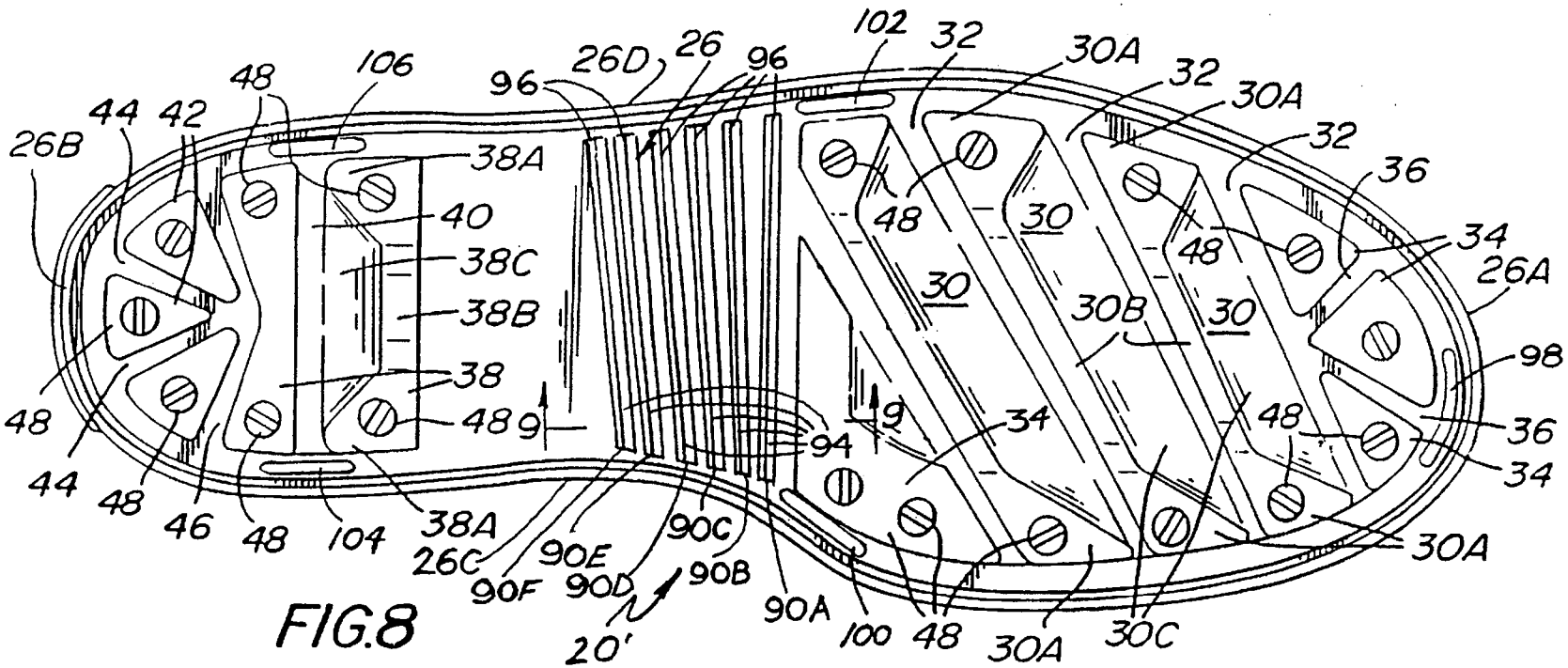
26A
98
36
34
34
36
32
30A
32
30A
32
30A
30
30
30
30B
30C
30A
30A
48
48
48

FOOTWEAR HAVING A SOLE WITH A TOE STRAPPING ASSEMBLY

RELATED APPLICATION

This application is a Continuation-In-Part of our earlier application Serial No. 08/296,829 filed on Aug. 26, 1994 now U.S. Pat. No. 5,533,277, entitled Footwear With Adherent Material Release Grooves, whose disclosure is incorporated by reference herein.

BACKGROUND OF THE INVENTION

This invention relates generally to footwear, and more particularly to attachments in the form of a sandal which is adapted to be worn over other footwear to render it resistant to slippage on ice or snow.

Various ice gripping, sandal-like, attachments for footwear are commercially available and have been disclosed in the patent literature. Examples of such patented devices are found in the following U.S. Patent Nos.: 1,032,600 (Grout); 2,361,972 (Smith); 3,214,850 (McNair); 3,516,181 (Jordan); 4,344,238 (Peyser); 4,353,172 (Bryant); 4,525,939 (McNeil et al.); and 4,910,883 (Zock, Jr.). While the devices disclose in those patents appear generally suitable for their intended purposes, they never the less appear to leave something to be desired from various standpoints, such as simplicity of construction, ease of mounting, removing, and adjusting.

Various sandals with means for enabling the adjustment of their mounting straps have been disclosed in the patent literature, such as the following U.S. Pat. Nos.: Des. 131,318 (Levin); 2,801,478 (Gilbert); 4,817,302 (Saltsman); 4,869,000 (York); and 4,920,664 (McGregor et al.). However, none of these sandals discloses a strapping arrangement which could be used with an ice gripping sole to obviate the disadvantages of the prior art ice gripping sandals.

The 32 North Corporation of Kennebunk Maine sells an ice gripping sandal for use on primary footwear under the trademark STABILICERS. That sandal includes a sole which is arranged to be secured to the bottom surface of the sole of a primary boot or shoe by means of two strapping assemblies, namely, a front or toe strapping assembly and a rear or heel strapping assembly. The front assembly comprises a longitudinally extending strap and a transversely extending strap which are releasably secured together by VELCRO fasteners to form a toe box for receiving the toe of the primary footwear therein to hold it in place. The rear assembly comprises a strap arranged to be extended over the instep of the primary footwear from one side of the sole to the other to hold the heel of the sandal's sole onto the heel of the primary footwear.

In order to prevent the toe portion of the sandal from presenting a tripping or snagging hazard the toe portion of the sandal's sole is bent upward. While this arrangement may somewhat lessen the potential for snagging, it still leaves much to be desired from this standpoint. This is particularly true since the toe strapping assembly is not particularly effective for holding the toe portion of the sandal's sole tightly against the toe portion of the primary footwear's sole.

The sole of the sandal has plural, spaced apart, chevron-shaped cleats or treads with screws at each end of each cleat for gripping ice. While the cleats may serve their desired purpose for gripping ice, the sole of the sandal between the cleats appears to be susceptible to clogging by adherent material, e.g., mud.

Thus, a need presently exists for a sandal which overcomes the deficiencies of the prior art.

OBJECTS OF THE INVENTION

Accordingly, it is a general object of this invention to provide a sandal which overcomes the disadvantages of the prior art.

It is another object of this invention to provide an sandal for use on primary footwear to provide slip resistance therefor and which sandal includes a sole arranged to readily release soft adherent material therefrom.

It is another object of this invention to provide a sandal includes a mounting strap assembly constructed so that the sandal can be easily mounted onto the sole of any type of primary footwear.

SUMMARY OF THE INVENTION

These and other objects of this invention are achieved by providing a sandal arranged for attachment to the sole of a primary footwear to provide a desired gripping function. The sandal comprises a sole and attachment strap means secured to the sole for attaching the sandal to the primary footwear.

The sole of the sandal has a longitudinal axis, a toe portion, a forefoot portion, an arch portion, a heel portion, a medial side, a lateral side, a top side, and a bottom side.

In accordance with one preferred aspect of this invention the bottom side of the sole comprises a first group of cleats located in both the toe portion and the forefoot portion, and a second group of cleats located in the heel portion. The cleats of the first group extend generally at an acute angle to the longitudinal axis and define therebetween plural grooves. Each of the grooves flares in size from the medial side of the sole of said sandal to the lateral side thereof to facilitate to ejection of soft adherent material therefrom. The arch portion of the sole has a plurality of recesses therein, each of which extends from adjacent the medial side of the sole to adjacent the lateral side of the sole. These recesses are confined to a region of said arch portion immediately adjacent the forefoot portion of the sole to enable the sole of the sandal to flex readily at that region.

DESCRIPTION OF THE DRAWINGS

Other objects and many attendant features of this invention will become readily appreciated as the same becomes better understood by reference to the following detailed description when considered in connection with the accompanying drawings wherein:

FIG. 8 is a bottom plan view of the bottom side of the sole of an alternative embodiment of the sandal shown in FIGS. 1 and 2; and FIG. 9 is a sectional view taken along line 9—9 of FIG. 8.

DETAILED DESCRIPTION OF THE PREFERRED EMBODIMENTS

Figure 1:
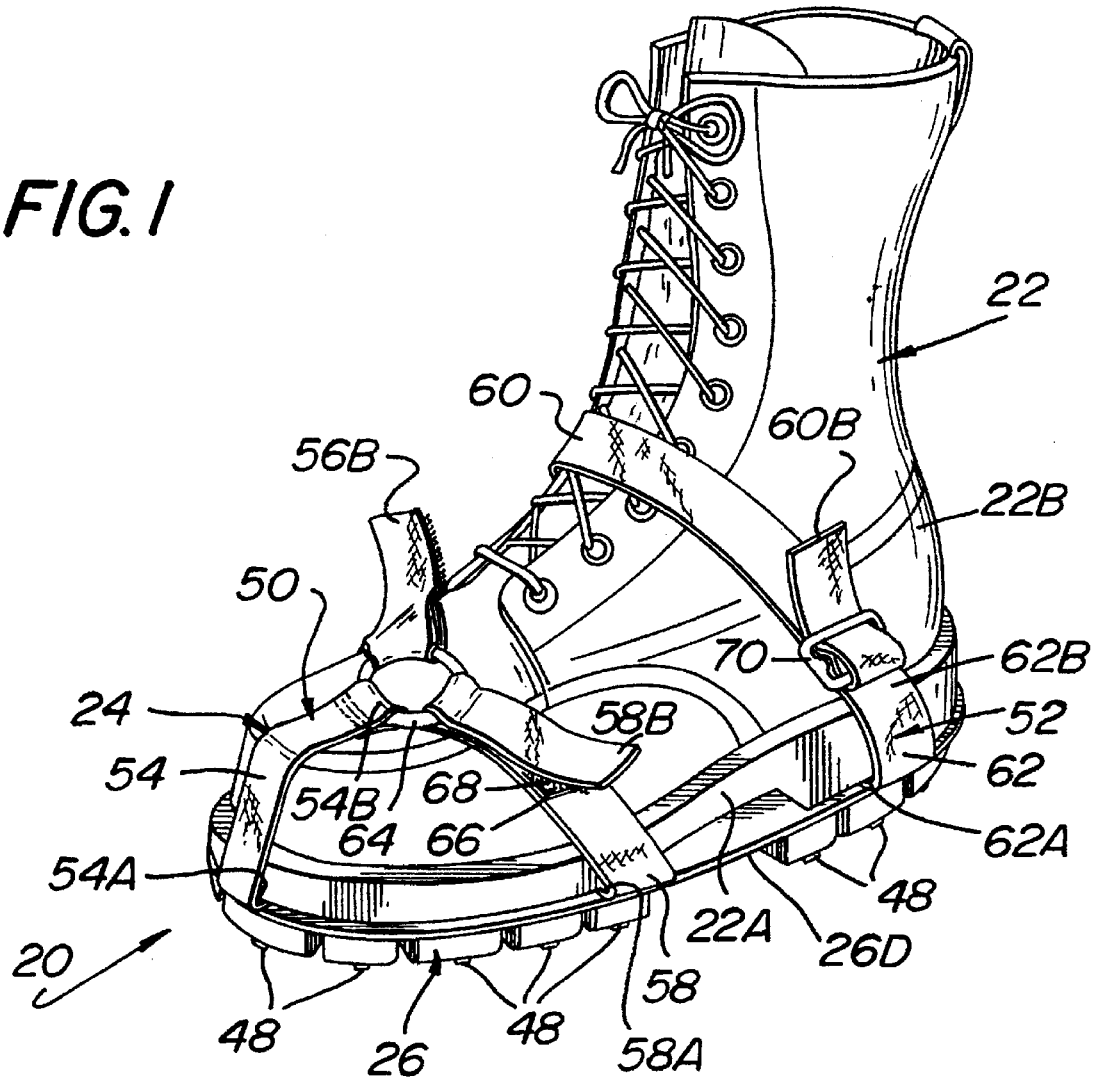
FIG. 1 is an isometric view of a conventional boot having an ice-gripping sandal constructed in accordance with this invention secured thereto by the sandal's strap assembly to provide slip resistance for icy surfaces.
Figure 7:
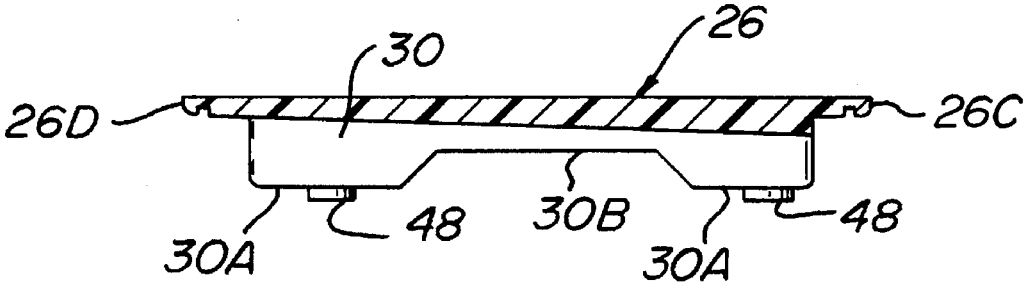
FIG. 7 is a sectional view taken along line 7—7 of FIG. 3.

Referring now to various figures of the drawing where like reference numerals refer to like parts there is shown at 20 in FIG. 1, a sandal constructed in accordance with this invention for securement to any type of conventional footwear 22, e.g., a boot, having a sole 22A and an upper 22B, to render the boot resistant to slippage on slippery surfaces. In accordance with a preferred embodiment of this invention the sandal is particularly suited for providing slip resistance on ice and its sole is particularly constructed for achieving that end while providing means for automatically effecting the release of soft materials, e.g., snow, slush, mud, etc., which would otherwise adhere to the sole.

The sandal 20 basically comprises a strap assembly 24 and a sole 26 having a primary footwear-heel retaining member 28 (FIG. 2) mounted thereon. The sole 26 includes plural groups of plural cleats on the undersurface thereof. In particular, a first group of angularly extending cleats 30 are located in the forefoot region of the sole. The cleats 30 will be described in detail later. Suffice it for now to state that they extend at an acute angle to the longitudinal axis of the sole and define plural adherent material releasing grooves 32 therebetween. A second group of generally triangularly shaped cleats 34 are located at the toe region of the sole and define plural grooves 36 therebetween. The cleats 34 are arranged so that their rear edges extend along the forward edge of the forward-most cleat 30 to define an adherent material release groove 32 between that cleat and the triangularly shaped cleats 34. Another, albeit larger, generally triangularly shaped cleat 34 is located in the forefoot-arch region of the sole. The larger triangular cleat 34 is arranged so its front edge extends along the rearward edge of the rearward-most cleat 30 to define an adherent material release groove 32 between that cleat and the larger triangularly shaped cleat 34. A pair of cleats 38 forming a third group are located in the heel region of the sole and define a groove 40 therebetween. A fourth group of generally triangularly shaped cleats 42 are located at the rearmost portion of the heel region of the sole and define plural grooves 44 therebetween. The cleats 42 are arranged so that their front edges extend along the rearward edge of the rearward-most cleat 38 to define an adherent material release groove 46 between that cleat and the triangularly shaped cleats 42.

Figure 4:
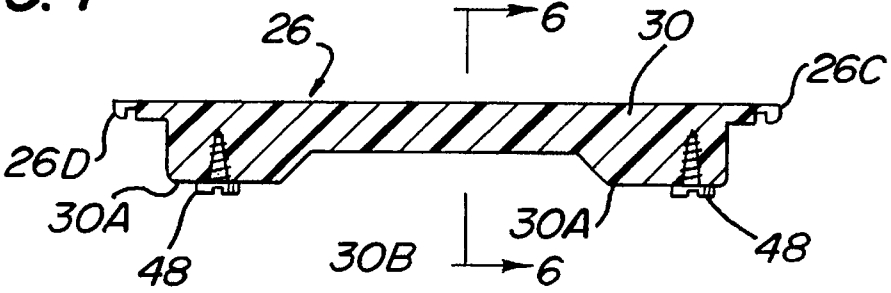
FIG. 4 is a sectional view taken along line 4—4 of FIG. 3.

As can be seen clearly in FIGS. 2 and 5, and as will be described later, each of the cleats 30, 34, 38, and 42 includes at least one top surface. The top surface is designated by the suffix letter "A" for each of the cleats and is disposed in the same plane as the top surfaces of all of the other cleats of the sole to serve as the ground engaging surface when the sandal is mounted on the primary footwear. Plural ice gripping projections in the form of slotted head, metal, screws are mounted on the cleats so that the head 48 of each screw projects beyond the plane of the ground engaging surface portion of each of the cleats, with the threaded shank 50 of each screw extending into a respective hole in the cleat as shown in FIG. 4.

The strap assembly 24 will be described in detail later. Suffice it for now to state it comprises a toe strapping subassembly 50 and a heel strapping subassembly 52. Each subassembly comprises plural elongated strap members which are secured to the sole 24 and which cooperate with one another to enable the sandal 20 to be mounted on the boot 22 so that the sole 26 of the sandal is disposed under the sole 22A of the boot 22 as shown in FIG. 1.

The sole 26 of the sandal can be of any conventional or non-conventional type of construction of any suitable somewhat flexible and/or resilient material, such as leather, rubber, plastic, etc., so long as it extends for the entire length and width of the sole 22A of the primary footwear, e.g., the boot 22, on which the sandal is to be mounted. Thus, as can be seen clearly in FIG. 3 the sole 24 of the sandal 20 includes a front end 26A, a rear end 26B, and a pair of sides, namely, a medial side 26C and a lateral side 24D. The pair of sides 26C and 26D are located on opposite sides of the sole's longitudinal axis.

Figure 2:
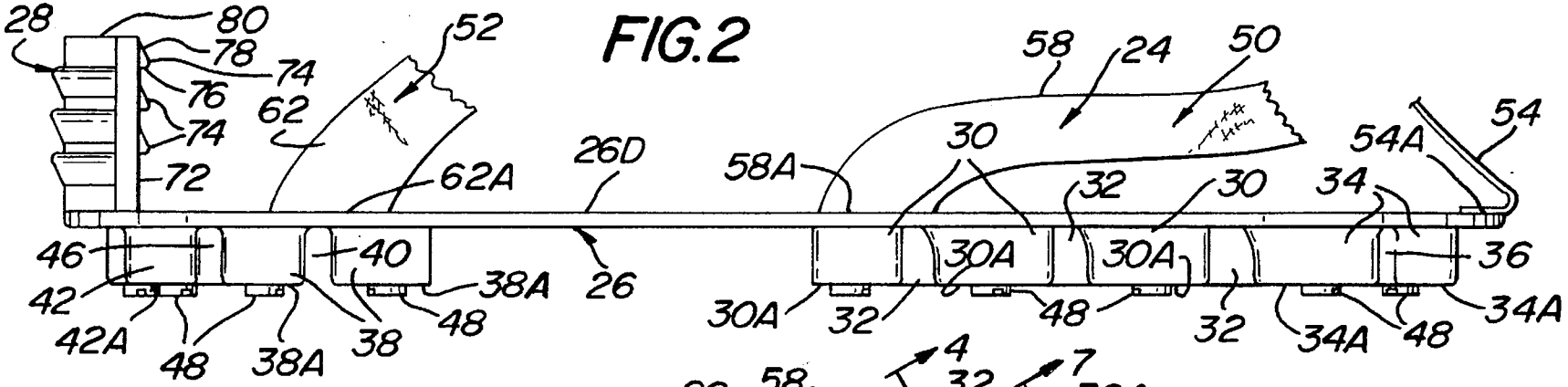
FIG. 2 is a lateral side elevational view of the sandal of FIG. 1.
Figure 5:
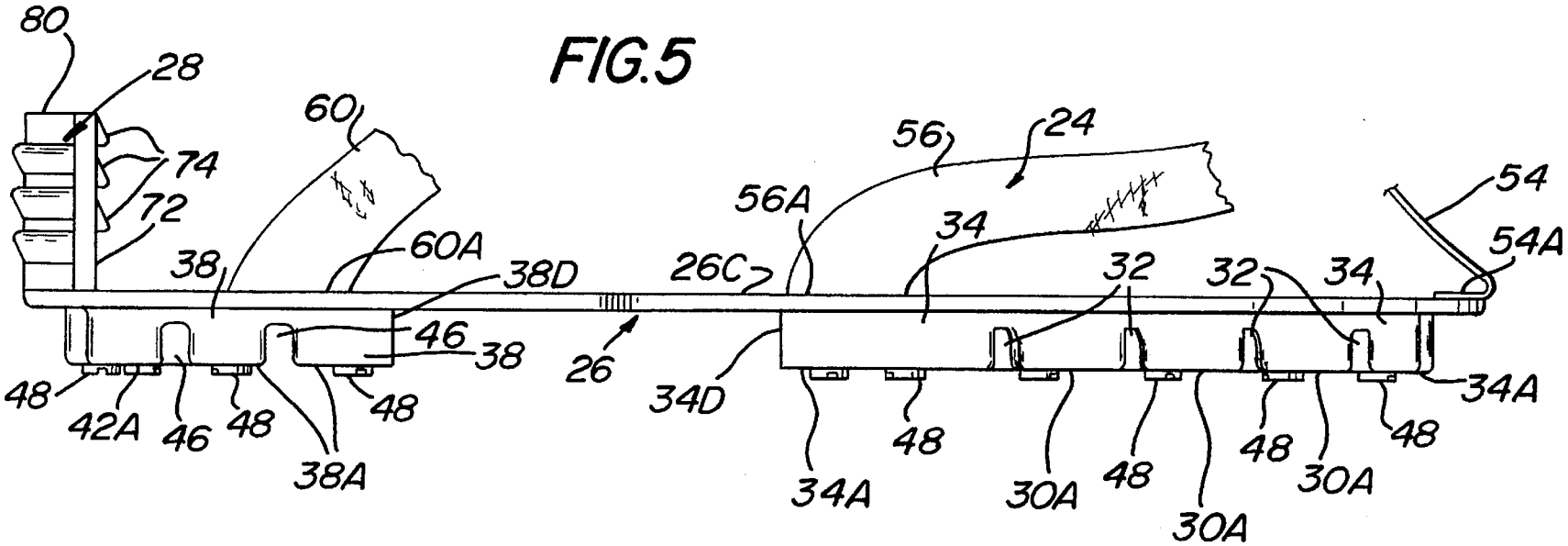
FIG. 5 is a medial side elevational view of the sandal of FIG. 1.

Referring now to FIGS. 1, 2 and 5 the details of the toe strapping subassembly 50 and the heel strapping subassembly 52 making up the strap assembly 24 will now be described. To that end the toe strapping subassembly comprises three elongated flexible straps 54, 56, and 58 which are connected to the sandal's sole in the toe and forefoot regions. The heel strapping subassembly comprises two elongated flexible straps 60 and 62 connected to the sandal's sole in the heel region.

The strap 54 of the toe strapping subassembly has one end 54A fixedly secured to the upper surface of the toe portion of the sole 24 and another end 54B having a ring 64 secured thereto. The ring 64 is secured by the end 54 of the strap 54 being extended through the opening in the ring and folded over itself and sewn together by plural stitches. The strap 56 of the toe strapping subassembly has one end 56A (FIG. 5) fixedly secured to the upper surface of the forefoot portion of the sole adjacent the medial side 26C and extends at an acute angle, e.g., approximately 45 degrees, to the longitudinal axis of the sole 26. The strap 56 has a free end 56B including a strip 66 of the hook component of a VELCRO® fastener mounted on the outer surface thereof. A cooperating strip 68 of the loop component of the VELCRO® fastener is mounted on the outer surface of the strap 56 toward the intermediate portion thereof. The free end 56B of the strap 56 is arranged to be extended through the opening in the ring 54 and folded back over itself so that the VELCRO® strips 66 and 68 releasably engage each other, thereby releasably securing the strap 56 to the strap 54. The strap 58 of the toe strapping subassembly has one end 58A (FIG. 2) fixedly secured to the upper surface of the forefoot portion of the sole adjacent the lateral side 26D and extends at an acute angle, e.g., approximately 45 degrees, to the longitudinal axis of the sole 26. The strap 58 has a free end 58B including a strip 66 of the hook component of a VELCRO® fastener mounted on the outer surface thereof. A cooperating strip 68 of the loop component of the VELCRO® fastener is mounted on the outer surface of the strap 58 toward the intermediate portion thereof. The free end 58B of the strap 58 is arranged to be extended through the opening in the ring 54 and folded back over itself so that the VELCRO® strips 66 and 68 releasably engage each other, thereby releasably securing the strap 58 to the strap 54. This action completes the formation of a toe box for receipt of the toe portion of the primary footwear, e.g., boot 22.

As should be appreciated by those skilled in the art each of the straps 56 and 58 can be independently releasably secured to the ring 54, with the length of the strap being adjustable by merely folding over more or less of the free end thereof through the ring as is desired. This feature enable the size and shape of the toe box to be adjusted to conform to the shape of the toe of the primary footwear. Moreover, the use of VELCRO® on the straps enables the size adjustment and securement to be accomplished quickly and easily.

The heel strapping subassembly 52 comprises the heretofore identified straps 60 and 62. Each of these straps is also formed of a flexible material like that forming the straps of the subassembly 50. As can be seen in FIGS. 1 and 5 the strap 60 has one end 60A fixedly secured to the top surface of the sandal's sole 26 in the heel region adjacent the medial side 26C and a free end 60B. As can be seen in FIGS. 1 and 2 the strap 62 has one end 62A fixedly secured to the top surface of the sandal's sole 26 in the heel region adjacent the lateral side 26D and a free end 62B on which a buckle 70 is fixedly secured. The strap 60 is arranged to be extended over the instep of the boot 20, as shown in FIG. 1, so that its free end 60B is releasably secured to the buckle 70 of the strap 62, after the toe strapping subassembly has been secured as described above, thereby completing the securement of the sandal on the boot.

The heel retaining member 28 is preferably formed integrally with the sole 26 and projects upward therefrom at the end 26B of the sole. The member 28 includes a forward surface 72 which is concave in shape to accommodate the convex rear surface of the heel of the primary footwear or boot 22. A plurality of ramp-shaped projections 74 project forward from the concave surface 72 and are disposed at different heights on the member 28. Each of the projections 74 includes a planar bottom surface 76 which is arranged to engage the protruding top surface edge of the boot's heel. The projections are provided at different heights on the member 28 in order to accommodate various boot heel thicknesses. Each of the projections includes a downwardly extending top surface 78 to enable the boot's heel to slide thereover when the sandal is mounted on the boot (being resilient the projections flex somewhat during this procedure), whereupon the planar bottom surface 76 of one of the projections 74 engages the protruding top surface edge of the boot to hold it in place.

The top of the member 28 is in the form of a planar surface 80, which acts as a convenient step upon which the other foot or ones hand can be placed to pivot the member 28 slightly to the rear, thereby releasing the engagement between the projection(s) 74 and the primary footwear's heel when the sandal is to be removed from the boot. The straps of the strapping subassemblies 50 and 52 can be undone either prior to or after the engagement between the projection 74 and the primary footwear's heel has been accomplished. In any case once the straps are disconnected and the member 28 pivoted backward slightly to release the engagement, continued pressure on the top surface 80 of the member 28 will tend to hold the sandal in place on the ground, whereupon the primary footwear can be readily removed by merely lifting it from the sandal.

Reference should now be made to FIGS. 2–7 wherein the details of the soft adherent material releasing grooves and of some of the cleats will now be discussed. As can be seen therein each of the grooves 32 flare in size from the medial side 26C of the sole of the sandal to the lateral side 26D thereof. In particular, each of the grooves 32 flares linearly in width and depth from the medial side to the lateral side, so that the width and depth of the groove at the medial side of the sole is less than the width and depth of the groove at the lateral side of the sole. In a preferred embodiment of this invention the width of each of the grooves 32 at the medial side is ⅛ inch (3.18 mm) and at the lateral side is ¼ inch (6.36 mm), while the depth of each of the grooves 32 at the medial side is ¼ inch (6.36 mm) and at the lateral side is ½ inch (12.7 mm).

As should be appreciated by those skilled in the art since the grooves 32 extend at an acute angle to the longitudinal axis of the sole as the wearer walks with the sandal's mounted on his/her boots, the normal pronation or rolling action across the forefoot region of the sandal causes any soft material, e.g., snow, slush, mud, etc., which would tend to adhere therein is, instead, forced or ejected out. In this regard that soft material is enabled to flow from the narrower portion of the grooves at the lateral side of the sole into the wider portion of those grooves and out the open end of the grooves at the medial side, whereupon that material is ejected from the grooves as the foot rolls inward during each step.

Figure 3:
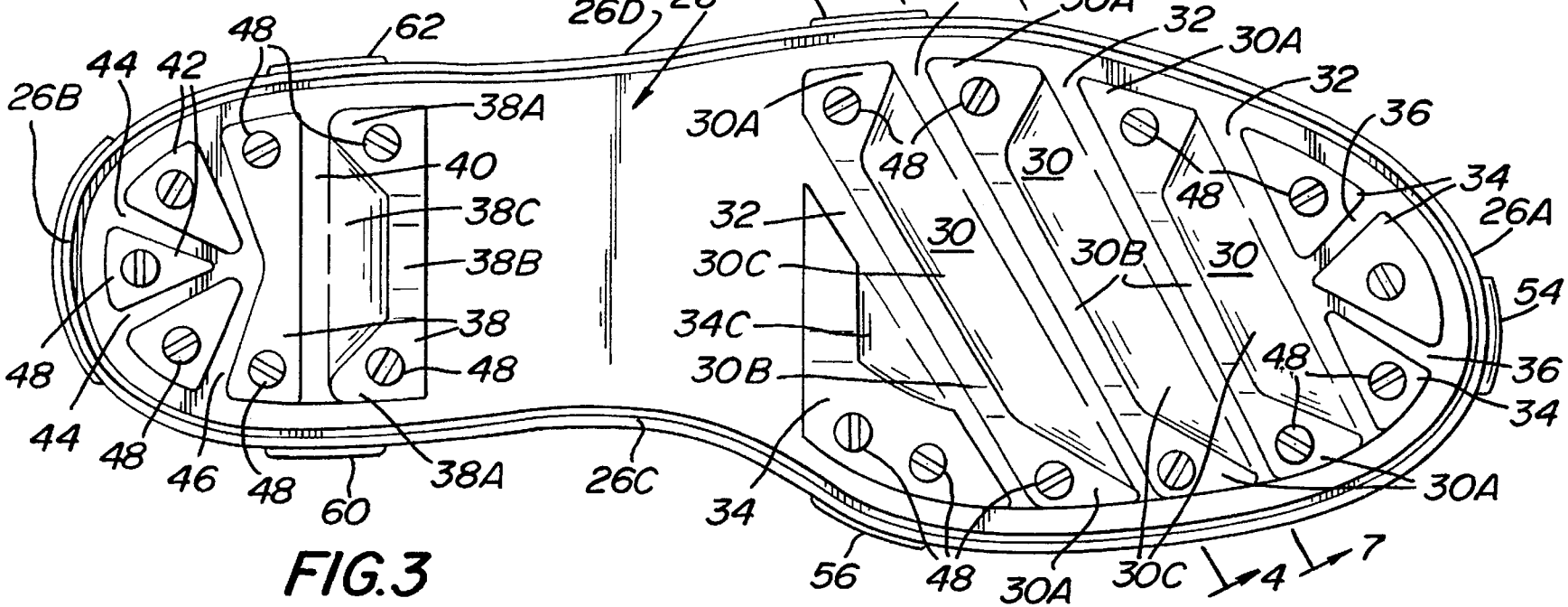
FIG. 3 is a bottom plan view of the bottom side of the sole of the sandal shown in FIGS. 1 and 2.

As can be seen in FIGS. 2, 3, and 5 the groove 40, while being of uniform width from the medial side of the sole to the lateral side thereof, never the less is flared in depth from the medial side to the lateral side. This arrangement facilitates the ejection of soft material therefrom during walking as the foot rolls inward during each step. If desired, the two grooves 36 between the triangular cleats 34 in the toe region may be configured to flare from their inner ends to their outer ends, i.e., the ends at the edge of the sole, to facilitate the ejection of soft material therefrom. So too, the two grooves 44 between the triangular cleats 342 in the heel region and the groove 46 between those cleats and the cleat 38 in that region may be configured to flare from their inner ends to their outer ends to facilitate the ejection of soft material therefrom.

The angularly extending cleats 30 are constructed so that their outer edges make good contact or engagement with the ground during walking, notwithstanding the presence of the screw heads 48 projecting therefrom. To that end each of the cleats 30 includes a pair of generally triangular shaped ends or nubs whose top surface 30A makes up the ground engaging surface for the cleat 30. A respective screw is mounted within each of the nubs 30A so that its head protrudes therefrom as described earlier. The portion of each cleats 30 between its nubs 30A is in the form of a narrow intermediate strip 30B whose top surface is below the top surface 30A of the nubs as shown in FIG. 4. This arrangement ensures that the nubs of the cleats engage the ground before the intermediate strip portions of the cleat.

Figure 6:
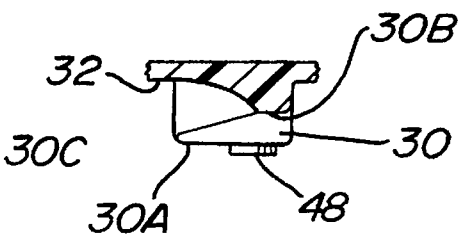
FIG. 6 is a sectional view taken along line 6—6 of FIG. 4.

As can be seen in FIGS. 4 and 6 the forward edge of each cleat 30 tapers downward from its top surfaces 30A and 30B to the bottom of the groove 32 immediately in front of that cleat. This tapering surface is arcuate at the point where it merges with the bottom of the groove 32. The tapering surface 30 of each of the cleats is provided to further enhance good ground engagement by the nub portions of the cleats, while channelling any soft material which may tend to adhere onto the cleat into the associated groove 32 for ejection therefrom during walking, as described heretofore. The forward edge of the large triangular cleat 34 includes a tapering surface 34C similar to recess 30C and that surface merges with the groove 32 for channelling soft material from the cleat 34 into that groove for ejection therefrom during walking.

The forward-most transverse cleat 38 is similar in construction to the cleats 30 and thus includes a pair of generally triangular shaped ends or nubs whose top surface 38A makes up the ground engaging surface for the cleat 38. A respective screw is mounted within each of the nubs 38A so that its head protrudes therefrom as described earlier. The portion the cleat 38 between its nubs 38A is in the form of a narrow intermediate strip 38B whose top surface is below the top surface 38A of the nubs. This arrangement ensures that the nubs of the cleat 38 engage the ground before the intermediate strip portions of thereof. Moreover, the rearward edge of the cleat 38 tapers downward from its top surfaces 38A and 38 to the bottom of the groove 40 immediately behind that cleat. This tapering surface is arcuate at the point where it merges with the bottom of the groove 40 and is provided to further enhance good ground engagement by the nub portions of the cleats, while channelling any soft material which may tend to adhere onto the cleat into the associated groove 40 for ejection therefrom during walking.

As can be seen in FIG. 5 the rearmost edge of the large triangular cleat 34 is designated by the reference numeral 34D and extends perpendicularly from the base. Of the sole 26 to serve as a stop surface. In a similar manner the forward-most edge of the forward-most transverse cleat 38 is designated by the reference numeral 38D and extends perpendicularly from the base of the sole 26 to also serve as a stop surface. The two stop surfaces 34D and 38D are provided to enable a rung of a ladder (not shown) to be accommodated therebetween when the sandals of this invention are used by a worker climbing a ladder, whereupon the particular stop surface being engaged by the ladder rung grabs onto it to thereby prevent the sandal from slipping off of the rung.

In FIGS. 8 and 9 there is shown an alternative embodiment of a sandal 20' constructed in accordance with this invention. The sandal 20' is in all respects identical to the sandal 20 described heretofore, except for the inclusion of a plurality of flexibility enhancing grooves (to be described hereinafter) and plural slots (also to be described hereinafter). Thus, in the interest of brevity the details of the construction and operation of the common components of the sandals 20 and 20' will not be reiterated herein. Moreover, the same reference numbers will be given for the common components of the sandals.

As can be seen in FIGS. 8 and 9 the sandal 20' includes a plurality of recesses 90A, 90B, 90C, 90D, 90E, and 90F located in the arch region of the sole immediately contiguous with the forefoot portion, i.e., immediately rearwardly of the rearmost cleat 34. Each of the recesses is a elongated linear recess of generally V-shaped cross-section, except that the bottom 92 of each recess is generally planar, as shown clearly in FIG. 9. Each recess includes one end 94 located closely adjacent the medial side 26C of the sole 26, and an opposite end 96 located closely adjacent the lateral side 26D of the sole 26 so that each recess extends substantially the full with of the sole in the region in which it is located. In accordance with one commercial embodiment, e.g., an "Extra-Large Size" sole, of the subject invention, the spacing between the ends 94 of the recesses at the medial side 26C of the sole of at least the five front-most recesses is less than the spacing between the ends 96 of those recesses at the lateral side 26D of the sole. The width of each of the recesses in that commercial embodiment is approximately 0.04 inch (1.02 mm), the depth of each of the recesses is approximately 0.085 inch (2.16 mm). The spacing between the recesses 90A and 90B on the medial side of the sole is approximately 0.312 inch (7.92 mm), and is approximately 0.4 inch (10.2 mm) on the lateral side of the sole. The spacing between the recesses 90B and 90C on the medial side of the sole is approximately 0.312 inch (7.92 mm), and is approximately 0.38 inch (9.65 mm) on the lateral side of the sole. The spacing between the recesses 90C and 90D on the medial side of the sole is approximately 0.312 inch (7.92 mm), and is approximately 0.365 inch (9.27 mm) on the lateral side of the sole. The spacing between the recesses 90D and 90E on the medial side of the sole is approximately 0.312 inch (7.92 mm), and is approximately 0.345 inch (8.76 mm) on the lateral side of the sole. The spacing between the recesses 90E and 90F on the medial side of the sole is approximately 0.312 inch (7.92 mm), and is approximately 0.312 inch (7.92 mm) on the lateral side of the sole. Thus, the recesses can be thought of being in a slightly fan-shaped array.

It should be pointed out that the aforementioned dimensions are merely exemplary so that the size and spacing of the recesses may differ depending upon several factors, e.g., sole size.

As should be appreciated by those skilled in the art the recesses 90A–90F provide an area of reduced thickness of the sole 20, so that the sole can readily flex thereat. This ensures that the wearer of the sandal can walk comfortably therein. In addition the recesses reduce the likelihood of the sole splitting immediately to the rear of the rearmost cleat 34. The inclusion of the recesses also facilitates the manufacture, e.g., injection molding, of the sole by providing pathways for the material to readily flow through the mold portions forming the recesses when injected through a mold gate at the toe portion of the sole.

The toe strapping subassembly 50 and the heel strapping subassembly 52 are secured to the sole 20 of the sandal 20' in a different manner than in sandal 20'. To that end, the sole 26 of the sandal 20' includes plural slots for securing respective ends of the straps making up the strap assembly 24. In particular, the sole 26 includes a slightly arcuate slot 98 extending through the thickness of the sole at the tip of the toe portion, and a first pair of generally linear slots 100 and 102 extending through the thickness of the sole at the medial and lateral sides of the sole adjacent the cleats 34 and 30A, respectively, and a second pair of generally linear slots 104 and 106 extending through the thickness of the sole at the medial and lateral sides of the sole adjacent the groove between the cleats 38.

The three elongated flexible straps 54, 56, and 58 of the toe strapping assembly are connected to slots 98, 100, and 102, respectively. This is accomplished by extending the end of these straps through these slots and securing them in place by any suitable means, e.g., the end of each of the straps which is extended through its associated slot may be folded over the edge of the sole and back to itself to form a loop, which is sewn in place. In a similar manner the ends of the two elongated flexible straps 60 and 62 of the heel strapping assembly are connected to the slots 104 and 106 in sandal's sole in the heel region.

It should be pointed out at this juncture that while the sandal of this invention has particular utility when worn over primary footwear, such as the boot shown, the sandal need not be used in that manner. Thus, the sandal of this invention can be used as primary footwear itself, i.e., the sandal may be worn directly on the foot. Moreover, the sandal 20 need not be constructed to include ice-gripping projections, be they screws or other types of projections.

In fact, the forefoot region of a sole of any primary footwear, e.g., a boot, or any footwear to be worn over other footwear, e.g., an overshoe, can be constructed in accordance with this invention so that it includes the heretofore described soft material releasing grooves and associated cleats.

It should also be pointed out at this juncture that while the preferred embodiment shown in FIGS. 8 and 9 includes six flex-grooves 90A–90F, the subject invention is not so limited. Thus, any desired number of grooves can be provided in a region of the arch area contiguous with the forefoot area, and the shape of the grooves need not be a flat bottom V-shape. What is important is that the recesses extend substantially the full width of the sole in the region in which they are located.

Without further elaboration the foregoing will so fully illustrate our invention that others may, by applying current or future knowledge, adapt the same for use under various conditions of service.

We claim:

1. Strap attachment means for use with a sandal to be worn on the foot of a wearer, the sandal comprising a sole including a heel portion, a forefoot portion, toe portion, a medial side, a lateral side, and a longitudinal axis, said attachment strap means comprising a toe strapping assembly connected to the sole of the sandal in the toe and forefoot portions, said toe strapping assembly comprises a first strap, a second strap, and a third strap, each of said straps being formed of a flexible material, said first strap having one end arranged to be connected to the toe portion of the sole and another portion having a connector member secured thereto, said second strap having one end arranged to be connected to the forefoot portion of the sole adjacent the medial side and extending at an acute angle to the longitudinal axis, said second strap having another end including continuously adjustable releasably securable means thereat, said third strap having one end arranged to be connected to the forefoot portion of the sole adjacent the lateral side and extending at an acute angle to the longitudinal axis, said third strap having another end including continuously adjustable releasably securable means thereat, said releasably securable means of said second and third straps being arranged to be releasably secured to said connector to form a toe box of continuously adjustable size for receipt of the wearer's toe.

2. The strap attachment means of claim 1 wherein said releasable securement means of said first and second straps comprise cooperating multi-loop and multi-hook fasteners.

3. The strap attachment means of claim 1 additionally comprising a heel strapping assembly connected to the sole of the sandal in the heel portion thereof.

4. The strap attachment means of claim 3 wherein said heel strapping assembly comprises a first strap and a second strap, each of said straps of said heel strapping assembly being formed of a flexible material.

5. The strap attachment means of claim 4 wherein said first strap of said heel strapping assembly has one end arranged to be connected to the heel portion of the sole adjacent the medial side and another end having releasably securable means secured thereto, and wherein said second strap of said heel strapping assembly has one end arranged to be connected to the heel portion of the sole adjacent the medial side and another end having releasably securable means secured thereto, said releasably securable means of said first and second straps of said heel strapping assembly being arranged to be releasably secured to each other to hold the heel of the wearer on the heel portion of the sole of the sandal.

6. Strap attachment means for use with a sandal to be worn on the foot of a wearer, the sandal comprising a sole including a heel portion, a forefoot portion, toe portion, a medial side, a lateral side, and a longitudinal axis, said attachment strap means comprising a toe strapping assembly and a heel strapping assembly, said toe strapping assembly being connected to the sole of the sandal in the toe and forefoot portions, said heel strapping assembly being arranged to be connected to the sole of said sandal in the heel portion, said toe strapping assembly comprises a first strap, a second strap, and a third strap, each of said straps being formed of a flexible material, said first strap having one end arranged to be connected to the toe portion of the sole and another end having a ring secured thereto, said second strap having one end arranged to be connected to the forefoot portion of the sole adjacent the medial side and extending at an acute angle to the longitudinal axis, said second strap having another end including continuously adjustable releasably securable means thereat, said third strap having one end arranged to be connected to the forefoot portion of the sole adjacent the lateral side and extending at an acute angle to the longitudinal axis, said third strap having another end including continuously adjustable releasably securable means thereat, said releasably securable means of said second and third straps being arranged to be releasably secured to said ring to form a toe box of continuously adjustable size for receipt of the wearer's toe.

7. The strap attachment means of claim 6 wherein said releasable securement means of said first and second straps is adjustable to enable the size and shape of said toe box to be adjusted to conform to a desired shape.

8. The strap attachment means of claim 7 wherein said heel strapping assembly comprises a first strap, and a second strap, each of said straps being formed of a flexible material, said first strap having one end arranged to be connected to the heel portion of the sole adjacent the medial side and another end having releasably securable means secured thereto, said second strap having one end arranged to be connected to the heel portion of the sole adjacent the medial side and another end having releasably securable means secured thereto, said releasably securable means of said first and second straps of said heel strapping assembly being arranged to be releasably secured to each other to hold the heel of the wearer on the heel portion of the sole of said sandal.

9. The strap attachment means of claim 6 wherein said heel strapping assembly comprises a first strap, and a second strap, each of said straps being formed of a flexible material, said first strap having one end arranged to be connected to the heel portion of the sole adjacent the medial side and another end having releasably securable means secured thereto, said second strap having one end arranged to be connected to the heel portion of the sole adjacent the medial side and another end having releasably securable means secured thereto, said releasably securable means of said first and second straps of said heel strapping assembly being arranged to be releasably secured to each other to hold the heel of the wearer on the heel portion of the sole of said sandal.

* * * * *